US012594488B2

(12) United States Patent
Carson

(10) Patent No.: US 12,594,488 B2
(45) Date of Patent: Apr. 7, 2026

(54) CHALLENGE CRIBBAGE GAME DEVICE AND METHOD

(71) Applicant: Keith Carson, Chemainus (CA)

(72) Inventor: Keith Carson, Chemainus (CA)

( * ) Notice: Subject to any disclaimer, the term of this patent is extended or adjusted under 35 U.S.C. 154(b) by 835 days.

(21) Appl. No.: 17/867,556

(22) Filed: Jul. 18, 2022

(65) Prior Publication Data

US 2023/0029253 A1 Jan. 26, 2023

Related U.S. Application Data

(60) Provisional application No. 63/223,931, filed on Jul. 20, 2021.

(51) Int. Cl.

| | |
|---|---|
| ***A63F 11/00*** | (2006.01) |
| ***A63F 1/04*** | (2006.01) |
| ***A63F 3/00*** | (2006.01) |

(52) U.S. Cl.

CPC ..... *A63F 11/0074* (2013.01); *A63F 1/04* (2013.01); *A63F 3/00006* (2013.01); *A63F 3/00082* (2013.01); *A63F 3/00574* (2013.01); *A63F 2003/00583* (2013.01); *A63F 2011/009* (2013.01)

(58) Field of Classification Search

CPC ..... A63F 3/00006

See application file for complete search history.

(56) References Cited

U.S. PATENT DOCUMENTS

| | | | | | |
|---|---|---|---|---|---|
| 4,598,912 | A | * | 7/1986 | Kendrick | A63F 3/00 273/245 |
| D420,399 | S | * | 2/2000 | Ackland | D21/343 |
| D441,804 | S | * | 5/2001 | Cutler | D21/343 |

FOREIGN PATENT DOCUMENTS

| | | | | | |
|---|---|---|---|---|---|
| CA | 1230585 | A | * | 12/1987 | A63F 1/04 |
| CA | 2369219 | A1 | * | 7/2003 | A63F 3/00006 |

OTHER PUBLICATIONS

Google AI search of rules of "Cribbage Wars" (debuted 1997) (Year: 1997).*

* cited by examiner

*Primary Examiner* — Kyle R Grabowski
(74) *Attorney, Agent, or Firm* — Island IP Law; Stephen R. Burri

(57) ABSTRACT

A challenge cribbage game comprising a cribbage board having at least two parallel player routes of 122 player holes along a path from a start position to a finish position, a single player hole at the finish position, and a plurality of challenge holes adjacent specific player holes along the parallel routes; providing a standard deck of cribbage playing cards; at least two pairs of matching player pegs and at least six additional challenge pegs; a list of challenge conditions, each corresponding to a challenge peg; placing each pair of matching player pegs in the first two holes of each player route; placing each challenge peg in a selected challenge holes; commencing game play consistent with the rules of cribbage; and varying game play from by following the directions of each challenge each time a player peg lands in a player hole adjacent a challenge hole containing a challenge peg.

8 Claims, 2 Drawing Sheets

CHALLENGE CRIBBAGE GAME DEVICE AND METHOD

BACKGROUND OF THE INVENTION

The present invention relates to tabletop games. In particular, the present invention relates to an improved cribbage game.

The well-known tabletop game of cribbage or "crib" is popular around the world. It is a card game and board game combined, usually played by 2-3 individuals or pairs. The game equipment comprises a single deck of playing cards, a game board having 2 or more parallel rows of 122 cylindrical depressions marking a path from start to finish, and 2 or more pairs of cylindrical pegs to be used to mark each player's progress along their designated path as game play ensues.

Boards may also include numerical markings to indicate players' progress along the path, and may include a terminal cylindrical depression to mark the finish. Boards are available in a variety of shapes, most commonly rectangular or shaped in the outline of the number "29", representing the maximum score of a hand in crib.

Although crib is an enjoyable game, it does not offer a high degree in variation in play. As players gain experience, the skill separation between players gradually is reduced, and the outcome of play largely is dependent on the deal of the cards. In order to increase interest in the game of crib, it is desirable to introduce additional elements into the game which provide a wider range of possible outcomes during play. The present invention achieves this objective simply and efficiently.

BRIEF SUMMARY OF THE INVENTION

There is provided a method of playing a challenge cribbage game, the method of playing comprising the steps of providing a cribbage board having at least two parallel player routes of 122 player holes along a path from a start position to a finish position, a single player hole at the finish position, and a plurality of challenge holes adjacent specific player holes along the parallel routes; providing a standard deck of cribbage playing cards; providing at least two pairs of matching player pegs and at least six additional challenge pegs; providing a list of challenge conditions, each corresponding to a challenge peg; placing each pair of matching player pegs in the first two holes of each player route; placing each challenge peg in a selected challenge holes; commencing game play consistent with the rules of cribbage; and varying game play from the rules of cribbage by following the directions of each challenge each time a player peg lands in a player hole adjacent a challenge hole containing a challenge peg.

The step of providing a board having at least two parallel player routes of 122 player holes may have three parallel player routes of 122 player holes. The step of providing at least two pairs of matching player pegs may comprise providing at least three pairs of matching player pegs.

The step of providing at least six additional challenge pegs may comprise providing at least twelve additional challenge pegs. The at least 12 challenge pegs may comprise at least six pairs of matching challenge pegs.

Placement of each challenge peg is completed by the player to the left of the dealer, by the dealer, or by all players in turn commencing with the dealer.

Player peg movement may be determined in part by a set of additional game conditions agreed upon by the players in advance, wherein the timing of application of each additional game condition is determined by placement of one or more challenge pegs into challenge holes adjacent specific player holes in a modified cribbage board having a plurality of challenge holes.

There is further provided a game board for playing the challenge cribbage game described, comprising a planar board having at least two parallel rows of 122 player holes in the upper playing surface extending from a board position marked Start to a board position marked Finish, and a single player hole in close proximity to the Finish; a plurality of challenge holes, each adjacent to a specific player hole; at least two pairs of intra-matching player pegs, each peg of a diameter selected to insert snugly into any of the player holes; at least six challenge pegs, each of a diameter selected to insert snugly into any of the challenge holes; and a list of enumerated game conditions, each corresponding to a specific challenge peg.

The game board may have a player peg depression in the game board for insertion therein of each player peg, and a peg depression in the game board for insertion therein of each challenge peg, each challenge peg depression enumerated to correspond to an enumerated challenge peg.

The game board may have three parallel routes of 122 player holes.

BRIEF DESCRIPTION OF THE DRAWINGS

A detailed description of the preferred embodiments is provided below by way of example only and with reference to the following drawings, in which.

Figure 1:
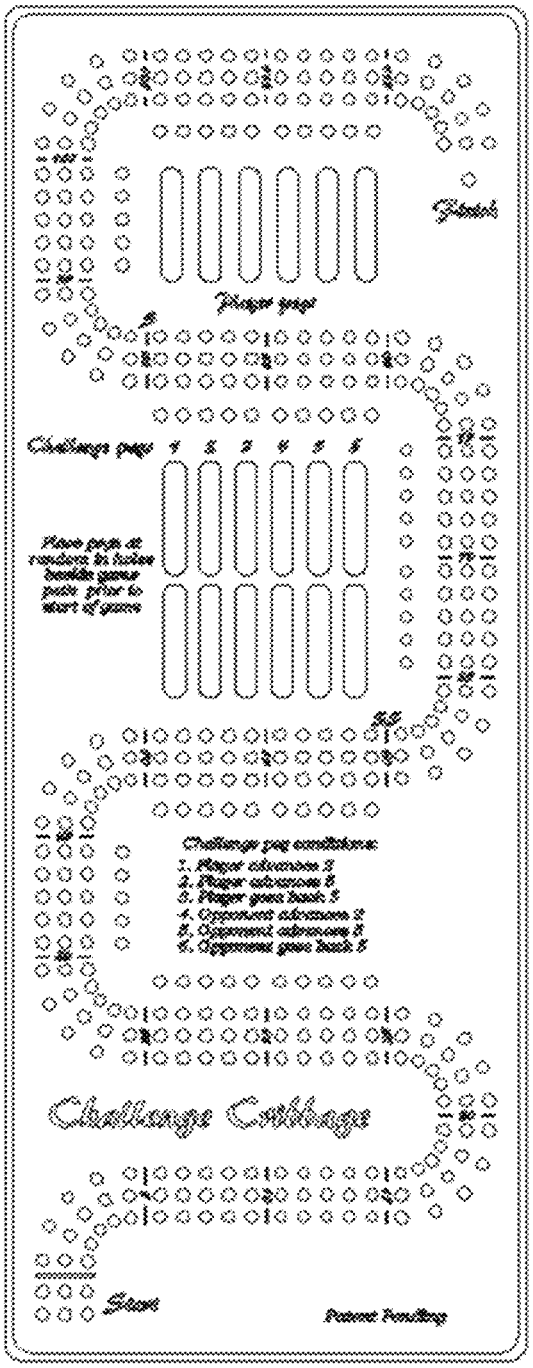
FIG. 1 is a top plan view of a preferred embodiment of the challenge cribbage board device of the present invention, having 12 challenge pegs.

In the drawings, one or more embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE INVENTION

As is known in the prior art, the challenge cribbage game device and method of the present invention includes the board, pegs, cards, and rules of the well-known game of cribbage.

Each of 2 players or teams is dealt a hand of 6 playing cards. Each player discards 2 cards to the "crib", an extra hand to be counted for the dealer at the end of the hand. Beginning with a designated player and continuing through all players, each player plays one card from their hand and announces the sum of that card and previously played cards. Points are scored by the player whose card brings the sum to 15, 31, or the sum closest to 31 after which the next player would exceed 31. Upon reaching 31 or the sum closest, the next player restarts the count from 0. Points are also scored for sequentially playing 2, 3, or 4 cards of the same value, or runs of 3 or more cards in sequence.

Once card play is completed, each player scores their hand of four dealt cards and an upturned card, counting combinations adding to 15, pairs, runs of 3 or more, flushes, and Jacks matching the suit of the upturned card, with the dealer counting their hand and crib last each round.

The cribbage board, on which each player's score is kept using a pair of pegs inserted into holes on the top surface, may be any shape but preferably is rectangular. As in the prior art cribbage game, the board includes 2 or 3 parallel rows of 122 holes tracing a path from a START line to a finish area. A single FINISH hole is provided beyond the parallel rows. According to a preferred embodiment of the present invention, a plurality of additional challenge holes is located adjacent the parallel rows of the player paths. The number of challenge holes may vary depending on the shape of the board and the available space. In the preferred embodiment shown in FIG. 1, there are 50 challenge openings provided across the first 80 player holes.

According to one embodiment of the challenge cribbage game of the present invention, an additional 6 pegs are provided, each a different colour. Prior to commencement of game play, each of the coloured pegs is placed in a challenge hole adjacent the player holes. Each coloured challenge peg corresponds to an added condition of game play, invoked upon a player landing their peg in a player hole adjacent the placed challenge peg.

In the challenge cribbage board embodiment depicted in FIG. 1, each of the colored pegs as placed in a depression labelled a) through f), and the corresponding added game conditions are as follows:

a) Player advances 2
b) Player advances 5
c) Player goes back 5
d) Opponent advances 2
e) Opponent advances 5
f) Opponent goes back 5

Alternatively, players may devise their own conditions for each peg for each game. Possible added game conditions may comprise player advancement or opponent advancement by a specific number of player holes, or movement of the player peg or opponent beg backwards by a specific number of player holes. Alternatively, conditions may comprise any other gamer condition consistent with the play of cribbage.

According to an alternate embodiment there may be provided 12 coloured pegs for use as challenge pegs, each usable to create an added game condition at a designated player hole.

According to the embodiment of the challenge cribbage game board shown in FIG. 1, there is further provided a peg depression in the surface of the board for holding each of the player pegs. In addition, there are provided additional peg depressions for holding up to 12 coloured challenge pegs. Preferably, a cover of plexiglass or other material is provided to retain the pegs in the depressions when the board is not in an upright horizontal position. For example, the board may be stored by hanging on a wall. A keyhole plug may be added to the back of the hoard to allow ease of wall hanging.

Figure 2:
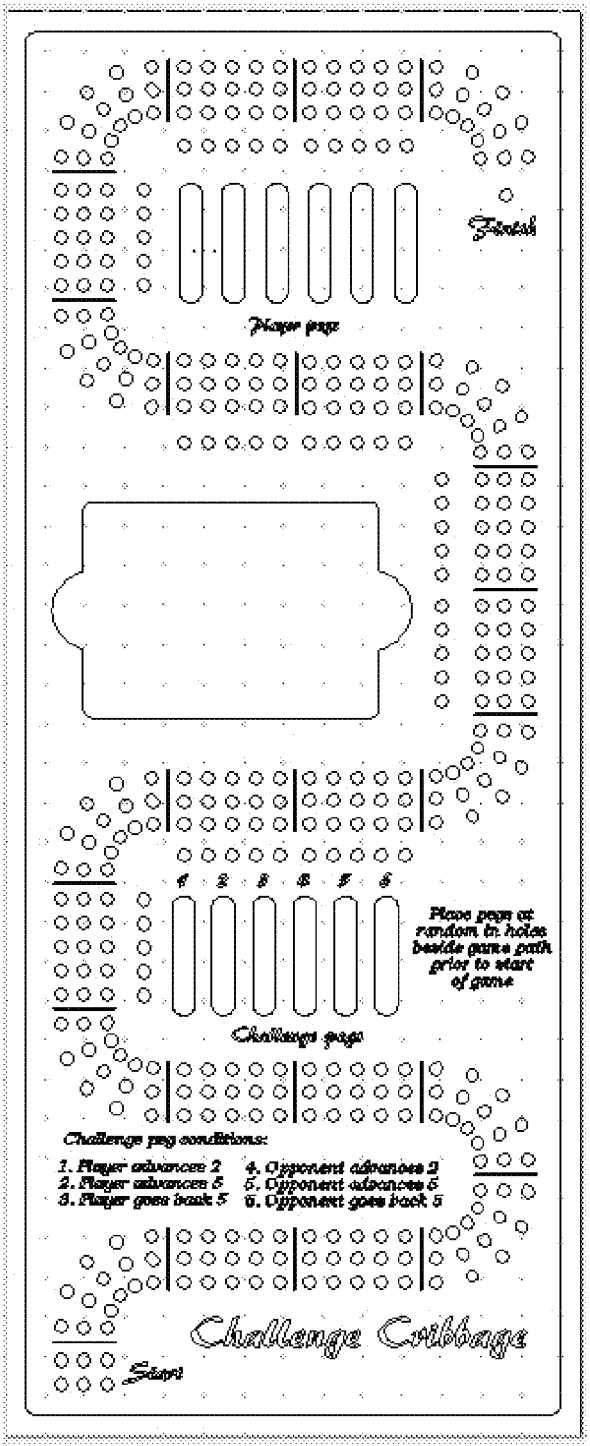
FIG. 2 is a top plan view of an alternate embodiment of the challenge cribbage board device of the present invention, having 6 challenge pegs and a depression for holding a deck of playing cards.

According to the embodiment of the game board shown in FIG. 2, there is provided a rectangular depression for placement of a deck of cards.

The game board may be of various shapes and sizes. A preferred embodiment is a rectangular board having dimensions 7.25 inches by 18 inches.

In this specification, the rules of cribbage refers to the Cribbage Official Tournament Rules of the American Cribbage Congress, which are incorporated by reference.

As many possible embodiments may be made of the invention without departing from the scope of the claims, it is to be understood that all matter herein set forth or shown in the accompanying drawings is to be interpreted as illustrative and not in a limiting sense.

It will be appreciated by those skilled in the art that other variations of the preferred embodiment may also be practised without departing from the scope of the invention.

The invention claimed is:

1. A method of playing a challenge cribbage game, the method of playing comprising the steps of: providing a cribbage board having at least two parallel player routes of 122 player holes along a path from a start position to a finish position, a single player hole at the finish position, and a plurality of challenge holes adjacent specific player holes along the parallel routes; providing a standard deck of cribbage playing cards; providing at least two pairs of matching player pegs and at least six additional challenge pegs; providing a list of challenge conditions, each corresponding to a challenge peg; placing each pair of matching player pegs in the first two holes of each player route; placing each challenge peg in a selected challenge holes; commencing game play consistent with the rules of cribbage; and varying game play from the rules of cribbage by following the directions of each challenge each time a player peg lands in a player hole adjacent a challenge hole containing a challenge peg.

2. The method of playing a challenge cribbage game of claim 1, wherein the step of providing a board having at least two parallel player routs of 122 player holes has three parallel player routes of 122 player holes.

3. The method of playing a challenge cribbage game of claim 1, wherein the step of providing at least two pairs of matching player pegs comprises providing at least three pairs of matching player pegs.

4. The method of playing a challenge cribbage game of claim 1, wherein the step of providing at least six additional challenge pegs comprises providing at least twelve additional challenge pegs.

5. The method of playing a challenge cribbage game of claim 4, wherein the at least 12 challenge pegs comprise at least six pairs of matching challenge pegs.

6. The method of playing a challenge cribbage game of claim 1, wherein placement of each challenge peg is completed by the player to the left of the dealer.

7. The method of playing a challenge cribbage game of claim 1, wherein placement of each challenge peg is completed by the dealer.

8. The method of playing a challenge cribbage game of claim 1, wherein placement of each challenge peg is completed by all players in turn commencing with the dealer.

* * * * *